US008303263B2

(12) United States Patent
Lim et al.

(10) Patent No.: US 8,303,263 B2
(45) Date of Patent: Nov. 6, 2012

(54) SWASH PLATE TYPE COMPRESSOR

(75) Inventors: Kweon-Soo Lim, Daejeon (KR); Duck-Bin Yoon, Daejeon (KR); Min-Gyu Kim, Daejeon (KR); Jung-Jae Lee, Daejeon (KR)

(73) Assignee: Halla Climate Control Corp., Daejeon (KR)

( * ) Notice: Subject to any disclaimer, the term of this patent is extended or adjusted under 35 U.S.C. 154(b) by 309 days.

(21) Appl. No.: 12/598,024

(22) PCT Filed: Apr. 18, 2008

(86) PCT No.: PCT/KR2008/002222

§ 371 (c)(1), (2), (4) Date: Oct. 28, 2009

(87) PCT Pub. No.: WO2008/147042

PCT Pub. Date: Dec. 4, 2008

(65) Prior Publication Data

US 2010/0129233 A1 May 27, 2010

(30) Foreign Application Priority Data

Jun. 1, 2007 (KR) ..... 10-2007-0054040

(51) Int. Cl.
*F04B 27/08* (2006.01)

(52) U.S. Cl. ..... 417/269; 91/499; 91/501; 384/618; 384/620

(58) Field of Classification Search ..... 417/269; 92/71; 91/499, 502; 384/618, 620, 622
See application file for complete search history.

(56) References Cited

U.S. PATENT DOCUMENTS 4,127,363 A * 11/1978 Kato et al. ..... 417/269
(Continued)

FOREIGN PATENT DOCUMENTS

JP 4-334776 A 11/1992
(Continued)

*Primary Examiner* — Devon Kramer
*Assistant Examiner* — Dominick L Plakkoottam
(74) *Attorney, Agent, or Firm* — Birch, Stewart, Kolasch & Birch, LLP

(57) ABSTRACT

The present invention relates to a compressor, wherein a rotary shaft 140 having a swash plate 144 coupled thereto is used to linearly reciprocate a piston 150 in a cylinder bore 134 formed in front and rear cylinder blocks 130 and 130'. The rotary shaft 140 has a flow channel 142 formed therein and inlets 142*a* formed to communicate with the flow channel 142. A hub 146 is formed in the swash plate 144, and a shaft hole 146*a*, through which the rotary shaft 140 passes, is formed in the center of the hub 146. Communication holes 146*b* are formed in the hub 146 to communicate with the inlets 142*a* of the flow channel 142. First races 148*a* are coupled to the hub 146. A rotary shaft hole 148*d* is formed in the first race 148*a*, which has a thickness greater in its outer peripheral portion than its inner peripheral portion. According to the present invention configured as above, the communication holes 146*b* are concavely formed in surfaces where inlets of the shaft hole 146*a* of the hub 146 are provided, so that the communication holes 146*b* can be formed together with the hub. Thus, there is an advantage in that the compressor can be easily manufactured. Also, the first race 148*a* has a thickness greater in its outer peripheral portion than its inner peripheral portion. Accordingly, there is an effect in that the strength of the first race 148*a* can be reinforced while keeping its damping effect, thereby improving durability of the swash plate type compressor.

4 Claims, 5 Drawing Sheets

U.S. PATENT DOCUMENTS

| | | | | |
|---|---|---|---|---|
| 5,183,394 | A * | 2/1993 | Fujii et al. | 417/269 |
| 5,975,763 | A * | 11/1999 | Shattuck et al. | 384/450 |
| 7,104,699 | B2 * | 9/2006 | Shattuck et al. | 384/621 |
| 2004/0094030 | A1 * | 5/2004 | Obayashi et al. | 91/499 |
| 2006/0228229 | A1 * | 10/2006 | Inoue | 417/269 |
| 2006/0239833 | A1 | 10/2006 | Park et al. | |

FOREIGN PATENT DOCUMENTS

| | | | |
|---|---|---|---|
| JP | 2003-314441 | A | 11/2003 |
| JP | 2006-291750 | A | 10/2006 |
| KR | 10-2005-0023741 | A | 3/2005 |
| KR | 10-2007-0019564 | A | 2/2007 |
| WO | WO 2007021095 | A1 * | 2/2007 |

* cited by examiner

SWASH PLATE TYPE COMPRESSOR

TECHNICAL FIELD

The present invention relates to a compressor, and more particularly, to a swash plate type compressor, in which a working fluid is transferred to a compression chamber through a flow channel formed in a rotary shaft and is compressed in the compression chamber by means of a piston driven by a swash plate installed to the rotary shaft.

BACKGROUND ART

Generally, a compressor used in an air conditioning system of a vehicle inhales a working fluid completely evaporated in an evaporator, converts the working fluid into the state that can be liquefied easily with high pressure and high temperature, and then transfers the working fluid to a condenser.

Such a compressor is classified into a reciprocating type compressor in which a component for compressing a working fluid is substantially reciprocated to compress the working fluid, and a rotary type compressor in which a component for compressing a working fluid is rotated. The reciprocating type compressor includes a crank type compressor that transfers driving force of a drive source using a crank shaft, a swash plate type compressor that transfers driving force using a rotary shaft to which a swash plate is installed, and a wobble plate type compressor using a wobble plate. The rotary type compressor includes a vane rotary type compressor using a rotating rotary shaft and vane, and a scroll type compressor using a rotating scroll and a fixed scroll.

FIGS. 1 and 2 schematically show a general swash plate type compressor, which will be explained with reference to the figures. Front and rear housings 10 and 20 and front and rear cylinder blocks 30 and 30' define an external appearance and a framework of a swash plate type compressor 1. The front and rear cylinder blocks 30 and 30' are coupled with each other, and the front and rear housings 10 and 20 are respectively coupled to both sides of the cylinder blocks 30 and 30'.

Discharge chambers 12 and 22 are respectively formed to be concave on surfaces of the front and rear housings 10 and 20, which are in contact with the front and rear cylinder blocks 30 and 30'. The discharge chambers 12 and 22 selectively communicate with a cylinder bores 34, which are provided in the front and rear cylinder blocks 30 and 30' along an inner peripheral surface of the front and rear housings 10 and 20, by means of valve units 60, which will be described later. A swash plate chamber 31 is formed to be concave on surfaces of the front and rear cylinder blocks 30 and 30', which are coupled to each other. A rotary shaft 40, which will be described later, is provided to pass through the swash plate chamber 31, and a swash plate 42 coupled to the rotary shaft 40 is positioned in the swash plate chamber 31.

A shaft support hole 32 is provided at the center of the front and rear cylinder blocks 30 and 30'. The shaft support hole 32 is a portion, in which a rotary shaft 40 to be explained later is inserted, and is designed to have an inner diameter such that an outer surface of the rotary shaft 40 is in close contact therewith.

A plurality of the cylinder bores 34 are formed in the front and rear cylinder blocks 30 and 30'. Pistons 50 to be explained later are respectively seated in the cylinder bores 34 and reciprocated to compress a working fluid.

The rotary shaft 40, which is rotated by means of an external drive source, is installed to pass through the shaft support hole 32 and the front housing 10. The swash plate 42 having a substantially disk shape is installed to the rotary shaft 40 slantingly with respect to an extension line of the rotary shaft 40. A cylindrical hub 44 is provided at the center of the swash plate 42, wherein the rotary shaft 40 passes through the hub 44 and is mounted with the swash plate 42. Communication holes 44' are bored through the hub 44 to communicate with the inside of the rotary shaft 40.

Bearings 45 are coupled to both sides of the hub 44. As shown in FIG. 3, the bearing 45 includes a first race 45*a* coupled to the swash plate 42, a second race 45*b* fixed to the front or rear cylinder block 30 or 30', and a cage 45*c* coupled between the first and second races 45*a* and 45*b* and provided with a plurality of needles B.

A plurality of shoes 46 are installed around a rim of the swash plate 42. The shoes 46 are configured to move along the rim of the swash plate 42.

A flow channel 47 in which a working fluid flows is formed in the rotary shaft 40. The flow channel 47 is formed in the rotary shaft 40 to extend in the lengthwise direction of the rotary shaft 40. The flow channel 47 communicates with the cylinder bores 34 and the communication holes 44', respectively.

The piston 50 for compressing a working fluid is installed in the cylinder bore 34 to make linear reciprocation therein. The piston 50 is connected to the swash plate 42 with the shoe 46 interposed therebetween, so that the piston 50 linearly reciprocates as the swash plate 42 rotates.

The valve units 60 are respectively installed between the front housing 10 and the front cylinder block 30 and between the rear housing 20 and the rear cylinder block 30'. The valve units 60 selectively communicate the cylinder bore 34 with the discharge chambers 12 and 22 to control discharge of the compressed working fluid.

A muffler 61 is formed in the front and rear cylinder blocks 30 and 30' to communicate with the discharge chambers 12 and 22. The muffler 61 serves to reduce pulsation and noise of a working fluid.

However, the aforementioned conventional compressor has the following problems.

Since the communication holes 44' are formed through the hub 44 of the swash plate 42, there needs a separate process for forming the communication holes 44' when the swash plate 42 is manufactured. Thus, there is a problem in that the swash plate 42 causes the man-hour needed for the works and the manufacturing time to increase.

DISCLOSURE

Technical Problem

The present invention is conceived to solve the aforementioned problems. An object of the present invention is to shorten a time required for manufacturing a swash plate by allowing a communication hole to be easily formed in the swash plate. Another object of the present invention is to prevent a bearing race from being broken down by axial force generated by the rotation of the swash plate.

Technical Solution

According to an aspect of the present invention for achieving the objects, there is provided a swash plate type compressor, which comprises front and rear housings having a discharge chamber formed therein and defining an external appearance of at least both ends of the swash plate type compressor; front and rear cylinder blocks positioned between the front and rear housings and having a shaft support hole formed to pass through a center thereof, the front and rear housing having a plurality of cylinder bores formed around the shaft support hole, the shaft support hole being respectively connected with the cylinder bores through a suction passage, the front and rear cylinder blocks having a swash plate chamber provided therein; a rotary shaft rotatably installed to pass through the front and rear cylinder blocks, the rotary shaft rotating together with a swash plate positioned in the swash plate chamber and slantingly installed to the rotary shaft, the rotary shaft being formed with a flow channel that allows a working fluid introduced into the swash plate type compressor to the cylinder bores through the flow channel; a plurality of pistons connected to the swash plate with shoes being interposed therebetween, the plurality of pistons reciprocating in the cylinder bores according to the rotation of the swash plate; and bearings installed between both side surfaces of the swash plate and an inner surface of the swash plate chamber so that the rotary shaft rotates in the swash plate chamber smoothly, wherein a hub is formed at a center of the swash plate and is formed with a shaft hole into which the rotary shaft is inserted and fixed, the hub being formed with communication holes communicating with the flow channel, the communication holes being open in surfaces which are in contact with the bearings.

The bearing may include first and second races, and a cage provided between the first and second races, the cage having needles rotatably installed thereto, and the first race has a thickness greater in its outer peripheral portion than its inner peripheral portion.

The first race may be gradually thicker as it goes from the inner peripheral portion to the outer peripheral portion.

The first race may be stepped so that the outer peripheral portion has a thickness greater than the inner peripheral portion.

Advantageous Effects

According to a swash plate type compressor of the present invention as described in detail above, the following advantages can be obtained.

First, since a communication hole is concavely formed in a surface where an inlet of a shaft hole of a hub is open, the communication hole need not be formed by an additional process when a swash plate is manufactured, but can be formed when making the hub of the swash plate, whereby it is possible to easily manufacture the compressor and to reduce the working time thereof.

In addition, since a race is formed to have a thickness greater in its outer peripheral portion than its inner peripheral portion, the race is improved in strength while its damping force is maintained. Thus, it is prevented that the communication hole causes rotational force of the swash plate to be lopsidedly applied to the race and thus the race is damaged, whereby there is an effect in that the durability of the compressor is improved.

BEST MODE

Hereinafter, preferred embodiments of a swash plate type compressor according to the present invention will be described in detail with reference to the accompanying drawings.

Figure 1:
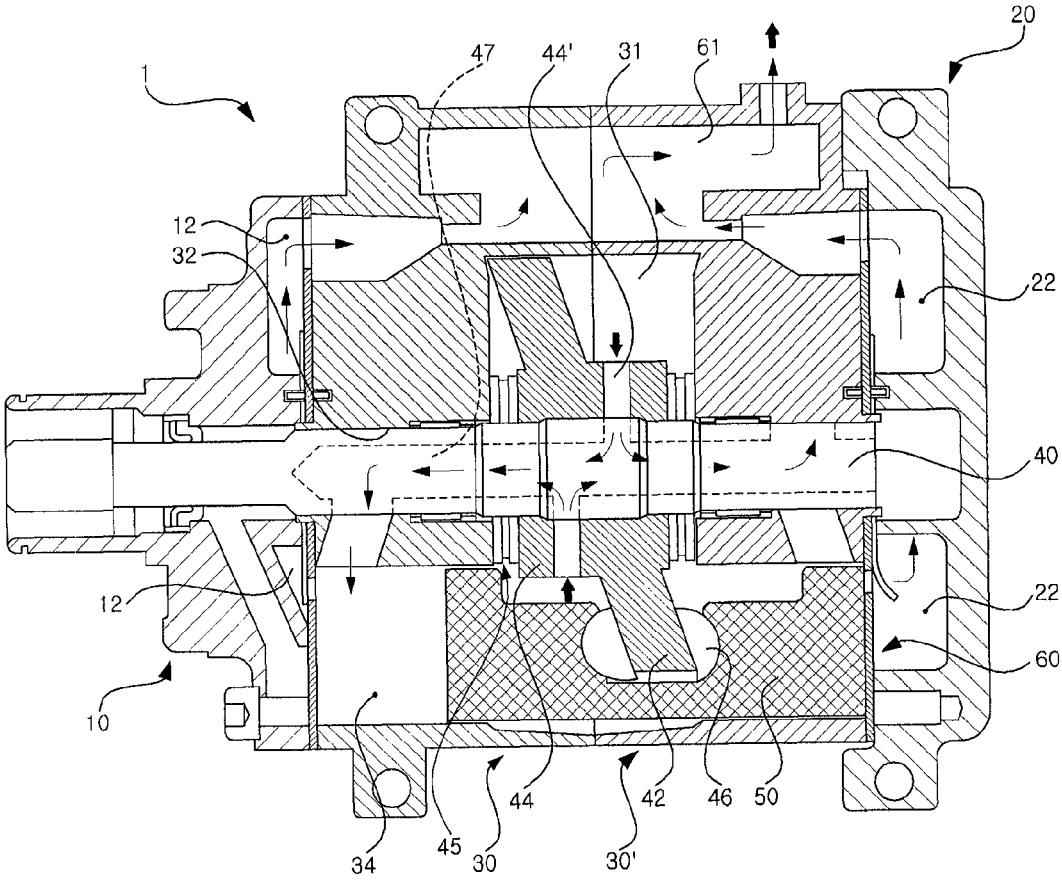
FIG. 1 is a partial sectional view showing a conventional swash plate type compressor.
Figure 2:
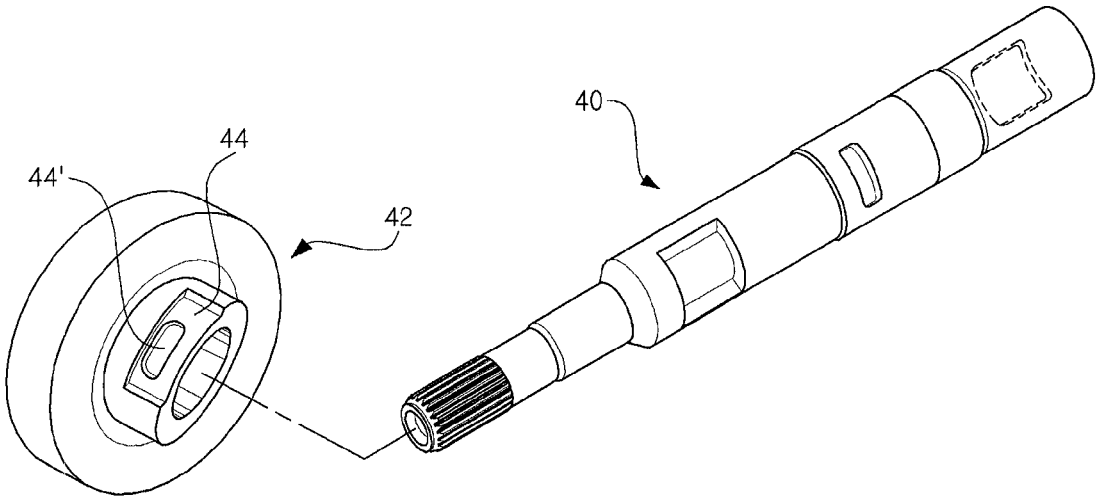
FIG. 2 is an exploded perspective view showing a rotary shaft and a swash plate employed in the conventional swash plate type compressor.
Figure 3:
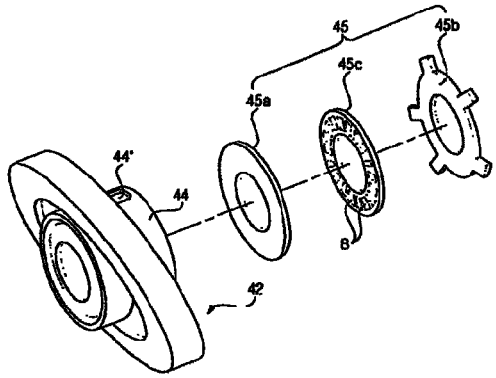
FIG. 3 is an exploded perspective view showing a bearing and a hub employed in the conventional swash plate type compressor.
Figure 4:
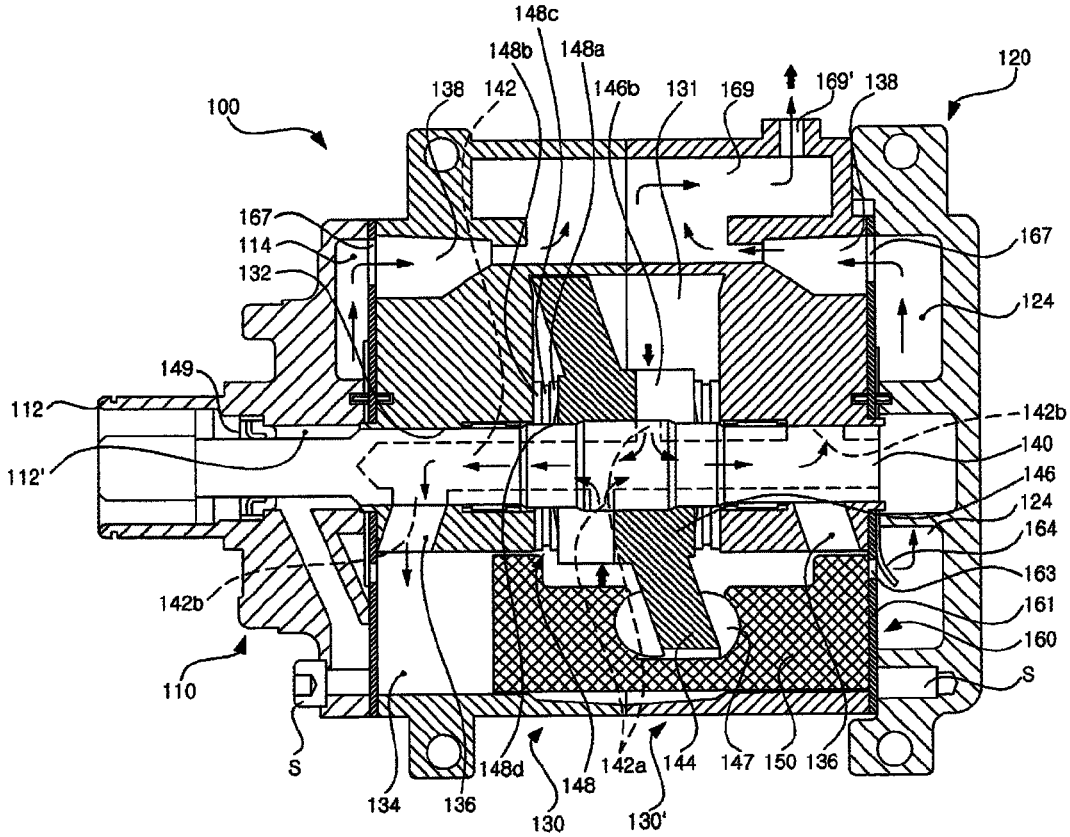
FIG. 4 is a partial sectional view showing a preferred embodiment of a swash plate type compressor according to the present invention.
Figure 5:
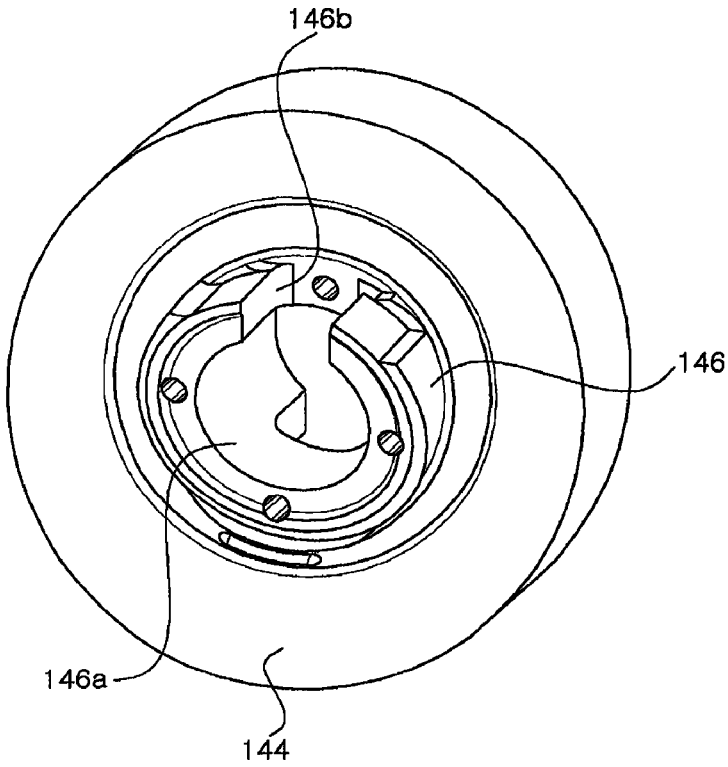
FIG. 5 is a perspective view showing a swash plate of the embodiment according to the present invention.
Figure 6:
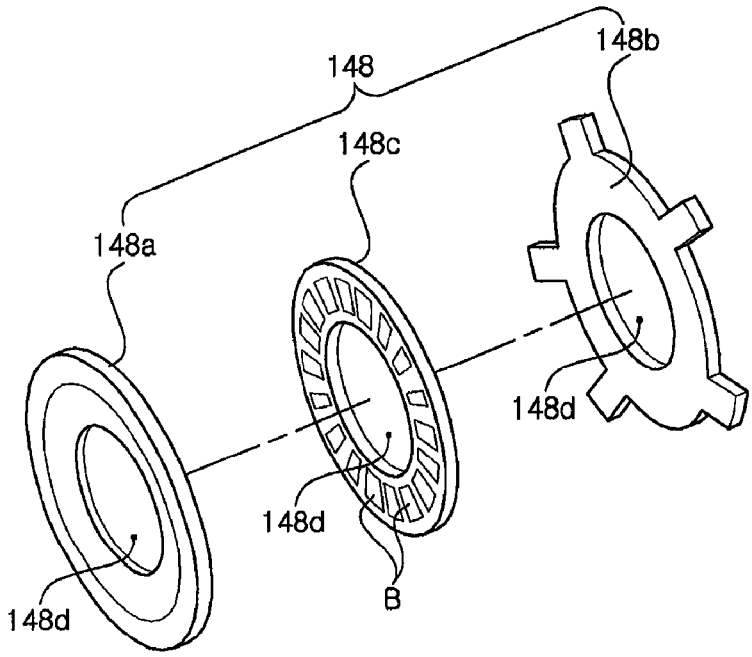
FIG. 6 is an exploded perspective view showing a bearing of the embodiment according to the present invention.
Figure 7:
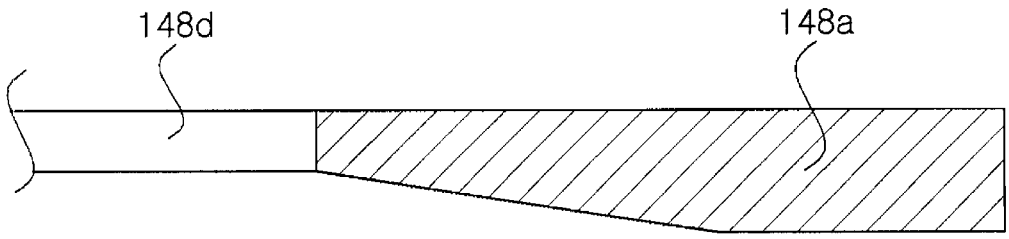
FIGS. 7 and 8 are sectional view showing embodiments of a first race.
Figure 8:
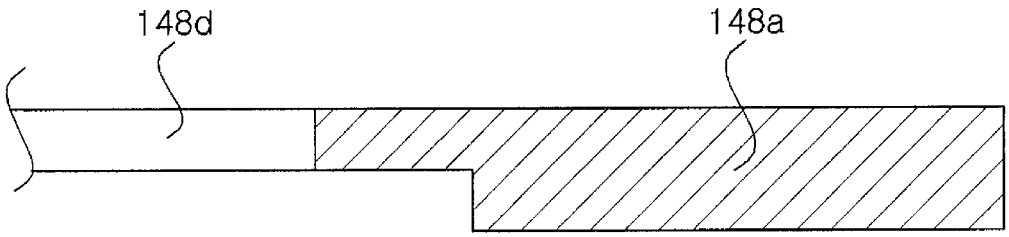

FIG. 4 is a partial sectional view showing a preferred embodiment of a swash plate type compressor according to the present invention, FIG. 5 is a perspective view showing a swash plate of the embodiment according to the present invention, FIG. 6 is an exploded perspective view showing a bearing of the embodiment according to the present invention, and FIGS. 7 and 8 are sectional view showing embodiments of a first race.

According to the figures, front and rear housings 110 and 120 and front and rear cylinder blocks 130 and 130' define an external appearance and a framework of a swash plate type compressor 100. The front and rear housings 110 and 120 are respectively installed to both ends of the front and rear cylinder blocks 130 and 130', which are already coupled with each other. The front and rear housings 110 and 120 together with the front and rear cylinder blocks 130 and 130' are coupled with each other by a fixing bolt S. That is, the fixing bolt S passes through all of the front and rear housings 110 and 120 and the front and rear cylinder blocks 130 and 130'. Unlike this embodiment, the front and rear cylinder blocks 130 and 130' may also be placed in and then coupled with the front and rear housings 110 and 120.

The front housing 110 is formed in the shape of a general disk, and a boss 112 is formed to protrude at the center of the front housing 110. The center of the boss 112 is formed with a shaft through hole 112', through which a rotary shaft 140 to be described later passes. A discharge chamber 114 is formed over a substantially ring-shaped region on a surface of the front housing 110, which faces the front cylinder block 130. The discharge chamber 114 selectively communicates with cylinder bores 134 provided in the front cylinder block 130 through a valve unit 160, which will be described later.

The rear housing 120 is mounted to one surface of the rear cylinder block 130'. A discharge chamber 124 is formed over a substantially ring-shaped region on a surface of the rear housing 120, which faces the rear cylinder block 130'. The discharge chamber 124 selectively communicates with the cylinder bores 134 provided in the rear cylinder block 130' through a valve unit 160 to be explained later.

Concave portions are formed in surfaces of the front and rear cylinder blocks 130 and 130' where they are coupled with each other, thereby defining a swash plate chamber 131. A swash plate 144 installed to a rotary shaft 140, which will be described later, is positioned and rotated in the swash plate chamber 131. A shaft support hole 132 is formed to pass through the center of the front and rear cylinder blocks 130 and 130' together with the front and rear cylinder blocks 130 and 130'. The rotary shaft 140 to be explained later is installed to pass through the shaft support hole 132. An inner diameter of the shaft support hole 132 is designed such that an outer surface of the rotary shaft 140 is in close contact therewith.

A plurality of the cylinder bores 134 with a cylindrical shape are formed in the front and rear cylinder blocks 130 and 130' around the shaft support hole 132 to extend in a lengthwise direction thereof. The cylinder bores 134 are formed respectively at corresponding positions of the front and rear cylinder blocks 130 and 130'. The cylinder bores 134 are connected to the shaft support hole 132 through suction passages 136. The suction passages 136 allow a working fluid transferred to a flow channel 142 of the rotary shaft 140, which will be described later, to be transferred to the cylinder bores 134, respectively.

A discharge passage 138 is formed in the front and rear cylinder blocks 130 and 130' to communicate with the discharge chambers 114 and 124. The discharge passage 138 functions as a passage through which a working fluid compressed in the cylinder bores 134 is discharged to the outside.

Reference numeral 140 designates a rotary shaft. The rotary shaft 140 passes through the shaft through hole 112' and the shaft support hole 132 together and is rotatably installed to the swash plate type compressor 100. The rotary shaft 140 is rotated by receiving driving force for compressing a working fluid.

A flow channel 142 in which a working fluid flows is formed in the rotary shaft 140. The flow channel 142 is formed in the rotary shaft 140 to extend in a lengthwise direction of the rotary shaft 140. Inlets 142*a* are formed to pass through a portion of the rotary shaft 140 where the swash plate chamber 131 is positioned. The inlets 142*a* function as passages through which a working fluid introduced into the swash plate chamber 131 flows into the flow channel 142. Outlets 142*b* of the flow channel 142 are formed to pass through the rotary shaft 140. A working fluid introduced into the flow channel 142 flows into the cylinder bores 134 through the outlets 142*b*. The positions of the outlets 142*b* should be suitably selected according to a compression process of a working fluid, which is executed in the respective cylinder bores 134.

The swash plate 144 is coupled to the rotary shaft 140 at a position of the swash plate chamber 131. The swash plate 144 is coupled to the rotary shaft 140 slantingly at a predetermined angle with respect to the lengthwise direction of the rotary shaft 140. The swash plate 144 rotates together with the rotary shaft 140 and thus linearly reciprocates a piston 150, which will be described later, in the cylinder bore 134. A cylindrical hub 146 is provided at the center of the swash plate 144. A shaft hole 146*a* is formed at the center of the hub 146, so that the rotary shaft 140 penetrates the shaft hole 146*a* and is coupled thereto.

The hub 146 is formed with communication holes 146*b*. The communication holes 146b are formed to open in an outer peripheral surface of the hub 146 so as to communicate with the shaft hole 146*a*. The communication hole 146*b* is also open in one surface of the hub 146, in which an inlet of the shaft hole 146*a* is provided. That is, the communication hole 146*b* is concavely formed in the surface of the hub 146, where the inlet of the shaft hole 146*a* is provided. The communication hole 146*b* may be formed to have a cross section of a rectangular shape, as in this embodiment, or a circular or polygonal shape if necessary.

Since the communication hole 146*b* is concavely formed based on the surface where the inlet of the shaft hole 146*a* is open, no process for drilling the communication hole 146*b* is not necessary while the swash plate 144 is manufactured. Thus, the communication holes 146*b* may be formed more easily when the swash plate 144 is manufactured. The communication holes 146*b* are respectively formed in the hub 146 at positions corresponding to the inlets 142*a* of the rotary shaft 140.

Shoes 147 are respectively provided on both surfaces of a rim of the swash plate 144. The shoe 147 has a substantially semispherical shape and moves along the rim of the swash plate 144 to reduce frictional force between the swash plate 144 and the piston 150 that will be described later.

Bearings 148 are installed to both side surfaces of the hub 146. The bearing 148 allows the rotary shaft 140 with the swash plate 144 coupled thereto to be easily rotated in the swash plate chamber 131. Each bearing 148 includes first and second races 148*a* and 148*b* and a cage 148*c*. The first races 148*a* are respectively installed to be in contact with the side surfaces of the hub 146, and the second races 148*b* are respectively installed to be in contact with inner surfaces of the front and rear cylinder block 130 or 130'. Each cage 148*c* is provided between the first and second races 148*a* and 148*b*. A plurality of needles B are rotatably coupled to the cage 148*c*. The first races 148*a* are rotated together with the swash plate 144, and the second races 148*b* are respectively fixed to the front and rear cylinder blocks 130 and 130' such that the first races 148*a* can rotate together with the cages 148*c*. A rotary shaft hole 148*d* is formed at the right center of the first and second races 148*a* and 148*b* and the cages 148*c* such that the rotary shaft 140 passes through the rotary shaft hole.

The first races 148*a* are not in contact with portions of the hub 146 where the communication holes 146*b* are formed. That is, the first races 148*a* are not supported by the hub 146. Thus, the rotating force of the hub 146 may be lopsidedly applied to the first races 148*a*, and in a severe case, the first races 148*a* may be damaged. Thus, it is required to reinforce the strength of the first race 148*a*. Here, if the entire thickness of the first race 148*a* is increased, a damping effect may be deteriorated. Thus, in the present invention, the first race 148*a* is formed to have a thickness greater in its outer peripheral portion than its inner peripheral portion. FIGS. 7 and 8 shows embodiments of the first race 148*a* configured as above. According to the embodiment shown in FIG. 7, the first race 148*a* is gradually thicker as it goes away from the rotary shaft hole 148*d*. If the first race 148*a* is formed with such a shape, the damping effect of the first race 148*a* is maintained by the portion with a relatively smaller thickness, and the strength of the first race 148*a* is reinforced by the portion with a relatively greater thickness. The second race 148*b* may also be formed to have a gradually increased thickness as it goes away from the rotary shaft hole 148*d*, like the first race 148*a*. According to the embodiment shown in FIG. 8, the first race 148*a* is formed such that its central portion, more specifically a portion surrounding the rotary shaft hole 148*d*, is stepped by a predetermined amount. The first race 148*a* formed in this shape may also provide the same effect as the foregoing.

Reference numeral 149 designates a seal for sealing a gap between an inner surface of the shaft through hole 112' of the front housing 110 and an outer surface of the rotary shaft 140.

Each piston 150 is installed in the cylinder bore 134. The piston 150 has a substantially cylindrical shape corresponding to the inside of the cylinder bore 134, thereby compressing a working fluid introduced into the cylinder bore 134. For reference, if compression is made in the cylinder bore 134 where an end of one of the pistons 150 is positioned, suction is made in a cylinder bore 134 where the other end of the piston 150 is positioned. The piston 150 is coupled with the swash plate 144 so that the shoes 147 are interposed between the swash plate 144 and a central portion of the piston 150, and thus, is linearly reciprocated in the cylinder bore 134 by the rotation of the swash plate 144.

The valve units 160 are respectively installed between the front housing 110 and the front cylinder block 130 and between the rear housing 120 and the rear cylinder block 130'. The valve units 160 serve to control a working fluid introduced into the cylinder bore 134 to be discharged to the outside. A framework of the valve unit 160 is formed by a valve plate 161 having a general disk shape. Discharge holes 163 corresponding to the cylinder bores 134 are formed in the valve plate 161. Discharge reed 164 is respectively used to selectively open or close the discharge holes 163. The discharge reed 164 is made of an elastically deformable material, so that the discharge reed 164 is elastically deformed by pressure of a working fluid in the cylinder bore 134, thereby opening the discharge hole 163. A communication hole 167 is formed in the valve plate 161 at a position corresponding to the discharge passage 138. The communication hole 167 serves to allow each discharge chamber 114 or 124 to communicate with the discharge passage 138.

A muffler 169 is formed in the front and rear cylinder blocks 130 and 130' to communicate with the discharge passage 138. The muffler 169 serves to reduce pulsation and noise of a working fluid. A discharge port 169' for discharging a working fluid to a condenser (not shown) connected to the swash plate type compressor 110 is formed in the muffler 169.

Hereinafter, an operating process of the swash plate type compressor configured as above according to the present invention will be explained in detail.

If the rotary shaft 140 is rotated by driving force transferred from the outside, the swash plate 144 rotates together with the rotary shaft 140. As the swash plate 144 rotates, the pistons 150 linearly reciprocate in the respective cylinder bores 134.

As the rotary shaft 140 rotates, a working fluid introduced into the swash plate chamber 131 flows into the flow channel 142 through the communication holes 146*b*. As the rotary shaft 140 rotates, the outlets 142*b* of the rotary shaft 140 communicate with the suction passages 136 of the cylinder bores 134, and then, the working fluid introduced into the flow channel 142 flows into the cylinder bores 134. For reference, the working fluid is inhaled into the cylinder bore 134 when the piston 150 is positioned at a bottom dead center of the corresponding cylinder bore 134.

As the working fluid is transferred to the cylinder bore 134 and then the piston 150 in the corresponding cylinder bore 134 is moved toward the valve plate 161, the working fluid is compressed. As the working fluid is compressed, the pressure in the cylinder bore 134 is relatively increased. Then, the distal end of the discharge reed 164 is pushed and thus elastically deformed, so that the discharge hole 163 is opened.

If the discharge hole 163 is opened, the compressed working fluid is transferred to the discharge chambers 114 and 124, and then, the working fluid transferred to the discharge chambers 114 and 124 is transferred to the muffler 169 through the communication hole 167 via the discharge passage 138. Then, the working fluid is transferred toward the condenser through the discharge port 169' of the muffler 169.

Meanwhile, in this process, since the communication holes 146*b* are concavely formed from portions corresponding to the inlets of the shaft hole 146*a* and thus the driving force of the rotary shaft 140 is lopsidedly applied to the first race 148*a*, the first races 148*a* may be damaged. However, in the present invention, the first races 148*a* are formed gradually thicker as it goes away from the rotary shaft hole 148*d*, so that the strength of the first race 148*a* is reinforced. Thus, it is possible to decrease the damage of the first races 148*a*.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A swash plate type compressor, comprising:

front and rear housings having a discharge chamber formed therein and defining an external appearance of at least both ends of the swash plate type compressor;

front and rear cylinder blocks positioned between the front and rear housings and having a shaft support hole formed to pass through a center thereof, the front and rear cylinder blocks having a plurality of cylinder bores formed around the shaft support hole, the shaft support hole being respectively connected with the cylinder bores through a suction passage, the front and rear cylinder blocks having a swash plate chamber provided therein;

a rotary shaft rotatably installed to pass through the front and rear cylinder blocks, the rotary shaft rotating together with a swash plate positioned in the swash plate chamber and slantingly installed to the rotary shaft, the rotary shaft being formed with a channel that allows a working fluid introduced into the swash plate type compressor to the cylinder bores through the channel;

a plurality of pistons connected to the swash plate with shoes being interposed therebetween, the plurality of pistons reciprocating in the cylinder bores according to the rotation of the swash plate; and bearings installed between both side surfaces of the swash plate and an inner surface of the swash plate chamber so that the rotary shaft rotates in the swash plate chamber smoothly, wherein a hub is formed at a center of the swash plate and is formed with a shaft hole into which the rotary shaft is inserted and fixed, the hub being formed with communication holes communicating with the channel, the communication holes being open in surfaces which are in contact with the bearings, and wherein the bearing includes first and second races, the outer peripheral portion of the first race having increased thickness faces and contacts the hub of the swash plate.

2. The swash plate type compressor as claimed in claim 1, wherein the bearing has a cage provided between the first and second races, the cage having needles rotatably installed thereto, and the thickness of the outer peripheral portion of the first race is greater than the thickness of an inner peripheral portion of the first race.

3. The swash plate type compressor as claimed in claim 2, wherein the first race is gradually thicker as it goes from the inner peripheral portion to the outer peripheral portion.

4. The swash plate type compressor as claimed in claim 2, wherein the first race is stepped so that the thickness of the outer peripheral portion is greater than the thickness of the inner peripheral portion.

* * * * *